US005428330A

United States Patent [19]

Tamemoto

[11] Patent Number: 5,428,330

[45] Date of Patent: Jun. 27, 1995

[54] MAGNET SWITCH

[75] Inventor: Hiroaki Tamemoto, Kariya, Japan

[73] Assignee: Nippondenso Co., Ltd., Kariya, Japan

[21] Appl. No.: 320,789

[22] Filed: Oct. 11, 1994

Related U.S. Application Data

[63] Continuation of Ser. No. 98,835, Jul. 29, 1993, abandoned.

[30] Foreign Application Priority Data

Jul. 31, 1992 [JP] Japan ..... 4-205695

[51] Int. Cl.[6] ..... H01F 7/10

[52] U.S. Cl. ..... 335/236; 335/250; 335/277; 335/282

[58] Field of Search ..... 335/222, 223, 236, 237, 335/248, 250, 257, 277, 274, 282

[56] References Cited

U.S. PATENT DOCUMENTS

| | | | |
|---|---|---|---|
| 3,571,770 | 3/1971 | Dew . | |
| 3,755,766 | 8/1973 | Read, Jr. | 335/229 |
| 3,815,060 | 6/1974 | Turnbull | 335/133 |
| 4,124,192 | 11/1978 | White | 251/129 |
| 4,251,789 | 2/1981 | Russel et al. | 335/174 |
| 4,290,039 | 9/1981 | Tochizawa . | |
| 4,293,835 | 10/1981 | Davis et al. | 335/131 |
| 4,632,358 | 12/1986 | Orth et al. | 251/117 |
| 4,887,056 | 12/1989 | Kalino et al. . | |
| 4,987,396 | 1/1991 | Bogner . | |
| 5,135,027 | 8/1992 | Miki et al. | 137/596.17 |
| 5,217,047 | 6/1993 | McCabe | 137/625.61 |

FOREIGN PATENT DOCUMENTS

| | | |
|---|---|---|
| 1926833 | 5/1970 | Germany . |
| 2082393 | 3/1982 | United Kingdom . |
| 8802543 | 4/1988 | WIPO . |

OTHER PUBLICATIONS

Journal of Nippondenso Technical Disclosure, May 15, 1984, Ref. 35-091, Magnet Switch, Hirama Kazuo.

*Primary Examiner*—Leo P. Picard

*Attorney, Agent, or Firm*—Cushman, Darby & Cushman

[57] ABSTRACT

A magnet switch for a starter device includes a plunger on which a sufficient pull force can be exerted. The plunger drives a movable contact, and is guided by a sleeve so as to move therealong. An excited coil wound on a bobbin is provided around an outer periphery of the sleeve. The exciting coil is covered by a cylindrical frame of a magnetic material, and a bottom plate portion of the frame has an opening fitted on the outer periphery of the sleeve. A cushion spring is interposed between the bottom plate portion of the frame and the bobbin to hold the exciting coil in a predetermined position. The cushion spring has an annular portion disposed in contact with the bottom plate portion and the outer periphery of the sleeve, and a magnetic path can be formed between the annular portion and the plunger.

11 Claims, 4 Drawing Sheets

MAGNET SWITCH

This is a continuation of application Ser. No. 08/098,835, filed on Jul. 29, 1993, which was abandoned upon the filing hereof.

BACKGROUND OF THE INVENTION

1. Field of the Invention

This invention relates generally to a magnet switch, and more particularly to an improved magnet switch so designed as to form a more efficient magnetic circuit for a contact-drive plunger. The switch of this invention is used, for example, for controlling electric power supplied to a starter motor for starting an engine.

2. Description of the Prior Art

An engine mounted on an automobile is started by a starter motor. To this starter motor, electric power is supplied through a switch mechanism when an ignition switch is operated. A magnet switch is applied to the above switch mechanism, such as shown in U.S. Pat. No. 4,887,056. The magnet switch is supplied with drive electric power when the ignition switch is operated.

In the magnet switch, a plunger is provided in opposed relation to a stationary core, and an exciting coil wound on a bobbin is provided so as to surround the plunger. A frame made of a magnetic material is provided so as to surround the exciting coil. One end portion of this frame is connected to the stationary core, and the other end portion of the frame is disposed close to the outer peripheral portion of the plunger. With this arrangement, a magnetic circuit connecting the stationary core, the frame and the plunger to one another is constructed.

SUMMARY OF THE INVENTION

It is an object of the invention to provide a magnet switch for a starter motor or the like, which has a improved magnetic circuit as compared to the above magnetic circuit.

FIG. 7 shows a sectional view showing a essential part of a magnet switch for illustarting a prototype. A cylindrical plunger 51 is disposed within a cylindrical sleeve 52 in coaxial relation thereto, and the plunger 51 is movable along an axis thereof within the sleeve 52. An exciting coil 54 wound on a bobbin 53 of an electrically-insulative material is provided around an outer periphery of the sleeve 52. A frame 55 of a magnetic material is provided to surround the exciting coil 54.

In this case, the frame 55 has a bottom plate portion 551 provided in contact with the outer peripheral surface of the sleeve 52 on an end portion of the frame 55. Interposed between the bottom plate portion 551 and the bobbin 53 of the exciting coil 54 is a cushion spring 56 which urges the exciting coil 54 with the bobbin 53 toward a stationary core (not shown), i.e., in a right direction in FIG. 7. The exciting coil 54 is adapted to be located in a fixed position within the frame 55.

The cushion spring 56 is formed, for example, by cutting a ring-shaped piece out of a resilient metal sheet bent to a wavy configuration, as shown in FIGS. 8A and 8B. The cushion spring 56 is made, for example, of steel.

According to the prior work or prototype as shown in FIG. 7, a magnetic gap $\Delta a$ is formed between the bottom plate portion 551 of the frame 51 and the plunger 51. A main magnetic flux A exists at that portion of the bottom plate portion 551 disposed in opposed relation to the outer peripheral surface of the plunger 51. Since the area of this opposed portion is limited, a magnetic resistance of the magnetic gap $\Delta a$ is large, so that a leakage magnetic flux B inevitably develops. This leakage magnetic flux B flows in a magnetic path of a high magnetic resistance (i.e., in the air), and this means that the loss of a magnetomotive force is large.

The cushion spring 56 is made of steel capable of constructing a magnetic path, and is provided in a stable state of loosely fitted on the outer periphery of the sleeve 52. Therefore, a large gap $\Delta b$ is formed between the spring 56 and the plunger 51, and therefore the cushion spring 56 does not serve as part of the magnetic circuit.

Therefore, it is an object of this invention to improve a function of the cushion spring as part of the magnetic circuit in order that a magnetic pull force acting on a plunger is sufficiently large to ensure a reliable operation.

A magnet switch according to the present invention, includes a cylindrical plunger of a magnetic material movable along an axis thereof, a stationary core of a magnetic material provided in opposed relation to one end of the plunger, and an exciting coil being wound on a bobbin adapted to surround an outer periphery of the plunger. A frame is provided in surrounding relation to the exciting coil, one end portion of the frame being connected to the stationary core, the frame having a bottom plate portion formed at the other end thereof, and the bottom plate portion having an opening whose inner diameter is provided close to the outer periphery of the plunger, and a cushion spring is interposed between the bottom plate portion of the frame and the bobbin. The cushion spring includes a cylindrical inner peripheral wall disposed around the outer periphery of the plunger in closely spaced relation to the outer periphery, a contact portion held in contact with one of the bottom plate portion of the frame and the bobbin, and an urging portion urging the bobbin away from the bottom plate portion.

In the magnet switch of this construction, the frame surrounding the exciting coil is disposed very close to the plunger at its bottom plate portion, the contact portion of the cushion spring is held in contact with the bottom plate portion of the frame, and the inner peripheral portion of the cushion spring is disposed very close to the outer periphery of the plunger. Therefore, a main magnetic flux is formed between the bottom plate portion of the frame and the plunger, and also a main magnetic flux is formed between the inner peripheral wall of the cushion spring and the plunger. As a result, a sufficient magnetic pull force is exerted on the plunger. In this case, only the cushion spring is provided between the bottom plate portion of the frame and the bobbin having the exciting coil wound thereon, and therefore the axial length of the magnet switch does not need to be increased, and a compact design of the magnet switch can be achieved.

DESCRIPTION OF THE PREFERRED EMBODIMENTS

One preferred embodiment of the present invention will now be described with reference to the drawings.

Figure 1:
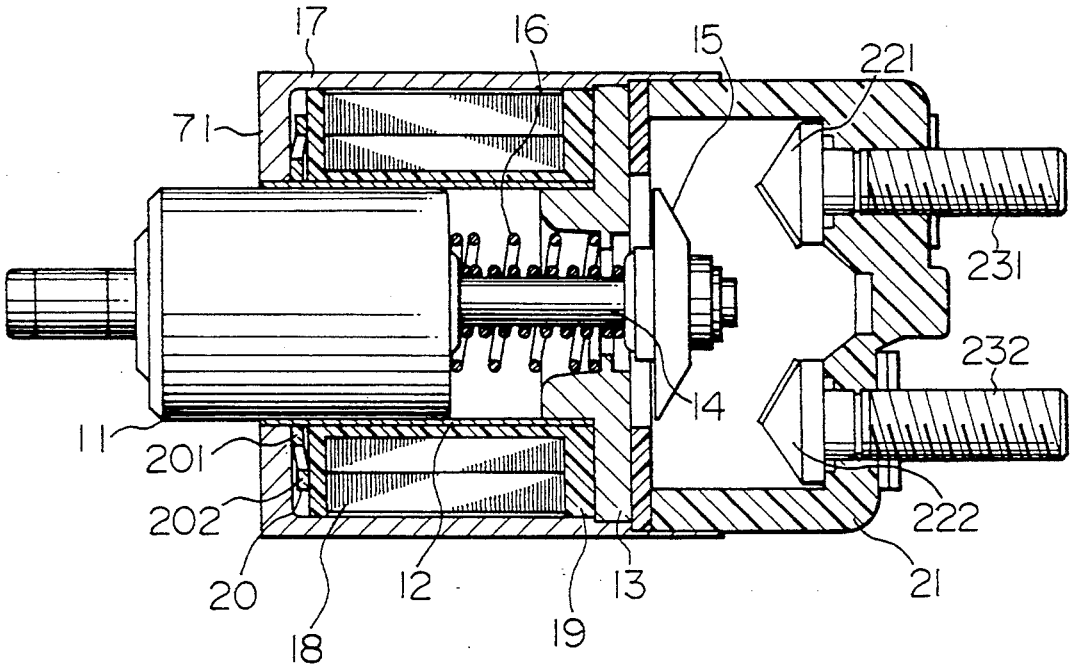
FIG. 1 is a cross-sectional view of a magnet switch provided in accordance with the present invention.

FIG. 1 shows a cross-sectional construction of a magnet switch. This magnet switch is provided with a cylindrical plunger 11 made of a magnetic material such as soft steel. The plunger 11 is provided in a cylindrical sleeve 12 of a non-magnetic material such as brass, and is guided by the sleeve 12 so as to move along an axis thereof.

A stationary core 13 made of a magnetic material is partly fitted in one end portion of the sleeve 12, and an opening is formed through a central portion of the stationary core 13, and a drive shaft 14 projecting from one end face of the plunger 11 is passed through this opening. An umbrella-shaped movable contact 15 of a trapezoidal cross-sectional shape is provided in opposed relation to that side of the stationary core 13 facing away from the plunger 11, and is integrally connected to the drive shaft 14. A compression spring 16 is interposed between the plunger 11 and the stationary core 13, and the plunger 11 is normally urged by this spring 16 in a direction away from the stationary core 13.

The stationary core 13 is provided to be fitted in one end portion of a cylindrical frame 17 of a magnetic material. An exciting coil 18 is provided to be contained within the frame 17. The exciting coil 18 is wound on a bobbin 19 of an electrically-insulative material provided to be fitted on the outer periphery of the sleeve 12.

The frame 17 has a bottom plate portion 171 covering one end surface of the bobbin 19, and the bottom plate portion 171 has an opening at the central portion of this bottom plate portion 171. Its inner peripheral surface is disposed in contact with the outer peripheral surface of the sleeve 12. A cushion spring 20 is interposed between the bottom plate portion 171 and the bobbin 19 having the exciting coil 18 wound thereon. The cushion spring 20 urges the bobbin 19 toward the stationary core 13 to hold the exciting coil 18 in a predetermined position.

Figure 2A:
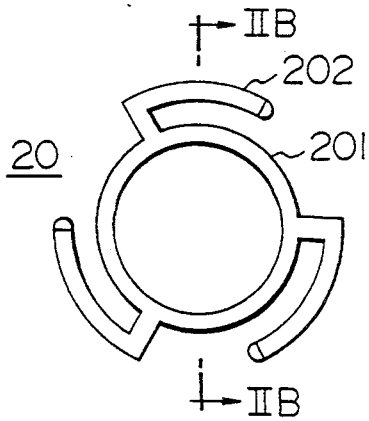
FIG. 2A is a plan view of a cushion spring incorporated in the magnet switch of FIG. 1.
Figure 2B:
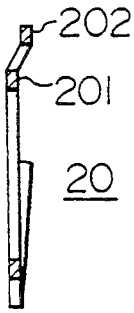
FIG. 2B is a cross-sectional view taken along the line IIB—IIB of FIG. 2A.

FIGS. 2A and 2B show the construction of the cushion spring 20. This spring 20 is made of magnetic steel, that is, a material allowing a magnetic flux to pass therethrough. The cushion spring 20 has a ring portion 201 (which serves as a contact portion) having such an inner diameter that the ring portion 201 is disposed in contact with the outer peripheral surface of the sleeve 12. A plurality of (three in the drawings) spring portions 202 are formed on the outer periphery of the ring portion 201. More specifically, each of spring portions 202 is defined by an arcuate portion (narrow piece) and an arm portion interconnecting this arcuate portion and the ring portion 201. Each arcuate portion is offset from the plane of the ring portion 201, and is slanting toward the bobbin 19. The three arcuate portions are disposed generally on an imaginary circle concentric with the ring portion 201.

The cushion spring 20 is interposed between the bottom plate portion 171 of the frame 17 and the bobbin 19 as described above, and in this condition one side or surface of the ring portion 201 is held in contact with the bottom plate portion 171, and the inner peripheral surface of the ring portion 201 is held in contact with the outer peripheral surface of the sleeve 12. Thus, the inner peripheral wall or surface of the ring portion 201 is disposed sufficiently close to the outer peripheral surface of the plunger 11.

Figure 3A:
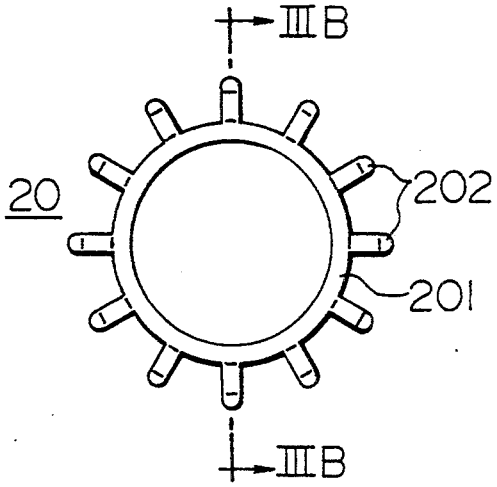
FIG. 3A is a plan view of a modified cushion spring.
Figure 3B:
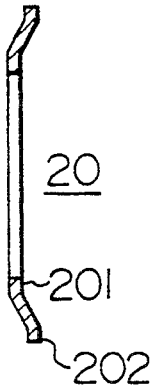
FIG. 3B is a cross-sectional view taken along the line IIIB—IIIB of FIG. 3A.
Figure 4A:
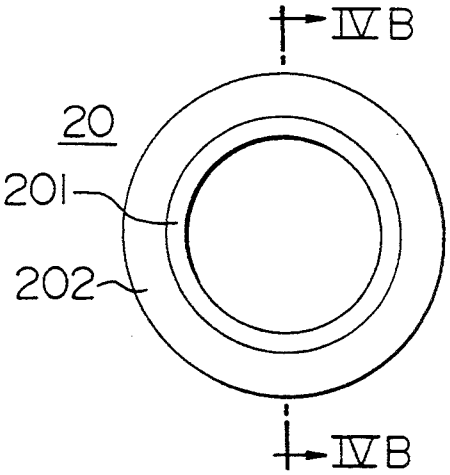
FIG. 4A is a plan view of another modified cushion spring.
Figure 4B:
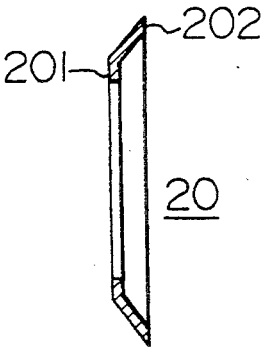
FIG. 4B is a cross-sectional view taken along the line IVB—IVB of FIG. 4A.

The cushion spring 20 used here may have various shapes. FIGS. 3A and 3B show a modified cushion spring 20 in which a plurality of arms (narrow pieces), which serve as spring portions 202, extend generally radially outwardly from a ring portion 201. FIGS. 4A and 4B show another modified cushion spring 20 of a belle-ville spring type in which an annular flange, which serves as a spring portion 202, is formed on an entire outer periphery of a ring portion 201, the flange 202 projecting out of the plane of the ring portion 201.

A cover 21 made, for example, of a resin is mounted on the end portion of the frame 17 in which the stationary core 13 fits, and a pair of fixed contacts 221 and 222 are provided within the cover 21 generally in opposed relation to the movable contact 15. When the movable contact 15 is moved against the bias of the spring 16, electrical connection between the two fixed contacts 221 and 222 is established through the movable contact 15 to form an electrical circuit between terminals 231 and 232 to thereby supply electric drive power to a starter motor (not shown).

In the magnet switch of the above construction, in order to cause the plunger 11 to smoothly move by an attraction force, the sleeve 12 made of a non-magnetic material is interposed between the frame 17 and the plunger 11. Therefore, a magnetic resistance greatly increases at the sleeve 12 to cause a magnetic flux loss.

Such a magnetic resistance can be reduced by increasing the cross-sectional area of a magnetic path disposed adjacent to the outer periphery of the plunger 11. For example, if a cylindrical portion is formed on the central portion of the bottom plate portion 171 of the frame 17, and extends along the outer peripheral surface of the plunger 11, the area of overlap between this cylindrical portion and the outer peripheral surface of the plunger 11 is increased, so that the magnetic resistance is decreased.

However, if the frame 17 is to be formed, for example, by pressing, the frame 17 must be shaped in such a manner that the cylindrical portion extends perpendicularly from the central portion of the bottom plate portion 171 of the frame 17, and at the same time the central hole for the passage of the plunger 11 therethrough must be formed by punching. Therefore, the pressing process becomes complicated. In addition, the axial length of the frame 17 is increased because of the provision of the cylindrical portion, so that the magnet switch has an increased size.

On the other hand, in the magnet switch of the present invention, one side or surface of the ring portion 201 of the cushion spring 20 facing away from the bobbin 19 is pressed against the bottom plate portion 171 of the frame 17 by its own resilient force, so that this ring portion 201 can be used as a magnetic path.

At the same time, since the inner diameter of the ring portion 201 of the cushion spring 20 is generally equal to the outer diameter of the sleeve 12, a gap between the inner peripheral surface of the ring portion 201 of the cushion spring 20 and the outer peripheral surface of the plunger 11 is very small. Namely, this gap has such a minimum value as to allow the ring portion 201 to fit on the sleeve 12. With this arrangement, the cross-sectional area of the magnetic path between the ring portion 201 of the cushion spring 20 and the plunger 11 can be efficiently increased.

Figure 5:
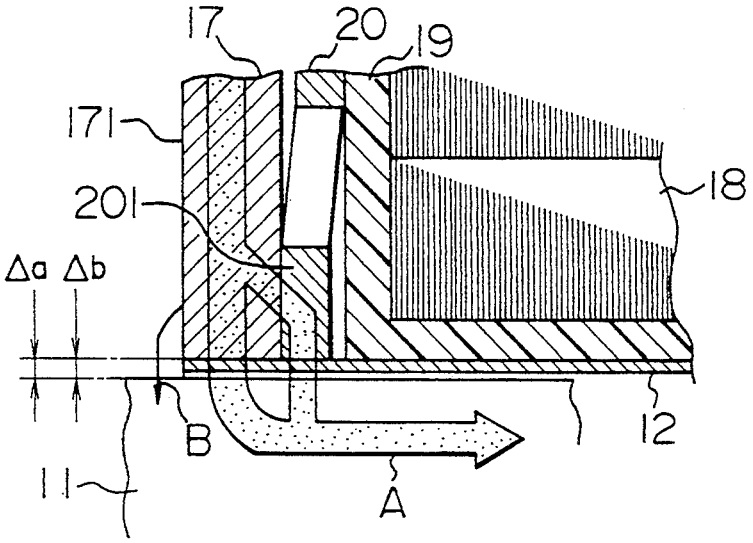
FIG. 5 is a partial cross-sectional view of a portion of the magnet switch, illustrating the manner of formation of a magnetic path.

FIG. 5 shows this magnetic path-constructing portion on an enlarged scale. The ring portion 201 of the cushion spring 20, as well as the inner peripheral surface of the central hole of the bottom plate 171 of the frame 17, is disposed in opposed relation to the outer peripheral surface of the plunger 11. Thus, the increased area of the opposed portions is obtained. In this case, the gap $\Delta a$ between the bottom plate portion 171 of the frame 17 and the outer peripheral surface of the plunger 11 is equal to the gap $\Delta b$ between the inner peripheral surface of the ring portion 201 of the cushion spring 20 and the outer peripheral surface of the plunger 11 (the value of the gaps $\Delta a$ and $\Delta b$ is determined mostly in accordance with the thickness of the sleeve 12), and the inner peripheral surface of the ring portion 201 is disposed sufficiently close to the outer peripheral surface of the plunger 11. Therefore, the cross-sectional area of the magnetic paths corresponding to the thickness of the bottom plate portion 171 and the thickness of the ring portion 201 is obtained, and a main magnetic flux A is formed also at this portion.

The frame 17 is made of soft steel, and the cushion spring 20 is made of spring steel or tool steel because of the necessity of a spring force. Therefore, the permeability of the cushion spring 20 is lower than that of the frame 17; however, the magnetic resistance of the sleeve 12 made of a non-magnetic material is very large with respect to the permeability of the spring 20.

Figure 6:
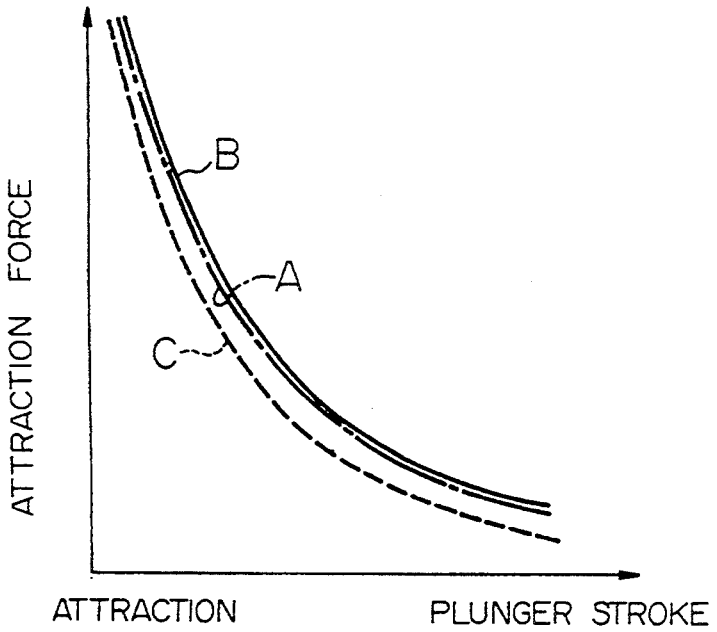
FIG. 6 is a graph showing results of tests related to a pull force acting on a plunger.
Figure 7:
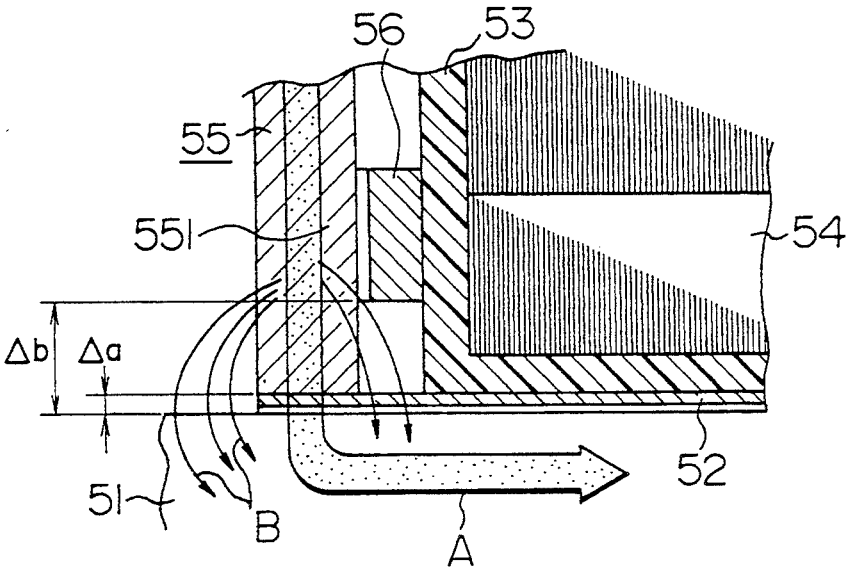
FIG. 7 is a sectional view showing an essential part of a magnet switch, for illustrating a prototype with the manner of formation of a magnetic path.

Plunger-attracting force tests were conducted with respect to a magnet switch (comparative switch) having a cylindrical portion extending from a central hole portion of a frame along a plunger, and a magnet switch of the present invention in which a ring portion 201 of a cushion spring 20 is pressed against a bottom plate portion 171 of a frame 17 as in the above embodiment. When the thickness of the ring portion 201 of the spring 20 was equal to the dimension of extension of the cylindrical portion of the comparative magnet switch, the force for attracting the plunger 11 in the magnet switch of the present invention was enhanced generally to the same degree as in the comparative magnet switch. FIG. 6 shows results of the tests. Curve A represents the results obtained with the magnet switch of the present invention, curve B represents the results with the magnet switch having the cylindrical portion projecting to the bottom plate portion of the frame as compared with the curve A, and curve C represents results with a prototype magnet switch as shown in FIG. 7.

Figure 8A:
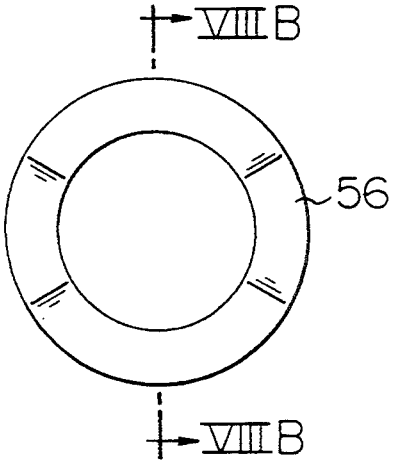
FIG. 8A is a plan view of a cushion spring used in the magnet switch of FIG. 7.
Figure 8B:
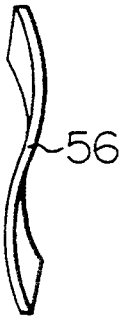
FIG. 8B is a cross-sectional view taken along the line VIIIB—VIIIB of FIG. 8A.

The cushion springs 20 shown in FIGS. 2A to 4B can be produced by stamping a steel sheet in a pressing operation, and the spring portion 202 can be obtained by a bending operation similar to that used in the production of the cushion spring 56 shown in FIGS. 8A and 8B. Furthermore, the cushion spring 20 can be installed in a single step, and therefore the pull force improvement of the magnet switch according to the invention will be accomplished at small cost.

The cushion spring 20 serves as the magnetic path, and therefore if the other parts are the same as those of the conventional construction, the number of turns of the exciting coil 18 can be reduced, which contributes to a compact and lightweight design.

Each of the above-mentioned cushion springs 20 may be mounted reversely so that the ring portion 201 is held against the bobbin 19 whereas the spring portion 202 is held against the bottom plate portion 171.

A further modified cushion spring is similar in configuration to the cushion spring of FIGS. 8A and 8B except that an inner periphery wall or surface thereof is disposed in closely spaced relation to the outer periphery of the plunger.

As described above, in the magnet switch of the present invention, the magnetic pull force acting on the plunger is enhanced without increasing the overall size of the magnet switch. Thus, the highly-reliable switch device of a more compact construction can be provided, and therefore can be used in a sufficiently reliable manner as a switch mechanism for a starter motor or the like.

What is claimed is:

1. A magnet switch comprising:

a cylindrical plunger of a magnetic material movable along an axis thereof;

a stationary core of a magnetic material provided so as to oppose one end of said plunger;

an exciting coil provided so as to surround an outer periphery of said plunger, said exciting coil being wound on a bobbin of an electrically-insulative material;

the outer periphery of said plunger having a cylindrical sleeve formed of a non-magnetic material such as brass, an inner diameteral of said cylindrical sleeve having a dimension thereof so as to slide in contact with an outer periphery of said plunger, and a radial thickness of said sleeve being thinner than that of an inner-diameteral cylindrical portion of said bobbin:

a frame of a magnetic material provided so as to surround said exciting coil, one end portion of said frame being connected to said stationary core, said frame having a bottom plate portion formed at the other end thereof, and said bottom plate portion having an opening whose inner peripheral surface is disposed close to the outer periphery of said plunger; and a cushion spring interposed between said bottom plate portion of said frame and said bobbin, said cushion spring being made of a magnetic material;

said cushion spring including a cylindrical inner peripheral wall disposed around the outer periphery of said plunger in closely spaced relation to said outer periphery and in contact with the outer diameteral portion of said sleeve, a contact portion held in contact with said bottom plate portion of said frame, an urging portion urging said bobbin away from said bottom plate portion, and said cushion spring includes an inner-diameteral portion that contacts an inner portion of said frame.

2. A magnet switch according to claim 1, in which said plunger is movable along an inner periphery of a cylindrical sleeve, and said inner peripheral wall of said cushion spring is loosely fitted on an outer periphery of said sleeve, so that said cushion spring is located around the outer periphery of said plunger.

3. A magnet switch according to claim 1, in which said cushion spring includes an annular portion having said inner peripheral wall, one side of said annular portion serving as said contact portion.

4. A magnet switch according to claim 3, in which said urging portion of said cushion spring is defined by a tubular portion of a truncated cone-shape which extends from an outer periphery from said annular portion, and is increasing in diameter progressively toward said bobbin, said urging portion urging said bobbin at a distal end of said urging portion.

5. A magnet switch according to claim 3, in which said urging portion comprises a plurality of arms extending from an outer periphery of said annular portion slantingly toward said bobbin, said arms urging said bobbin at their distal ends.

6. A magnet switch according to claim 5, in which each of said plurality of arms constituting said urging portion of said cushion spring comprises a narrow piece of an arcuate shape.

7. A magnet switch according to claim 5, in which each of said plurality of arms constituting said urging portion of said cushion spring comprises a narrow piece extending radially outwardly from the outer periphery of said annular portion.

8. A magnet switch according to claim 3, in which said contact portion of said cushion spring is held in contact with said bottom plate portion of said frame, said urging portion of said cushion spring being defined by a tubular portion of a truncated cone-shape which extends from an outer periphery of said annular portion, and is increasing in diameter progressively toward said bobbin, and said contact portion being held in contact with said bottom plate portion of said frame through reaction of a distal end of said urging portion.

9. A magnet switch according to claim 3, in which said contact portion of aid cushion spring is held in contact with said bottom plate portion of said frame, said urging portion comprising a plurality of arms extending from an outer periphery of said annular portion slantingly toward said bobbin, and said contact portion being held in contact with said bottom plate portion of said frame through reaction of distal ends of said arms.

10. A magnet switch according to claim 9, in which said plurality of arms defining said urging portion of said cushion spring include narrow pieces of an arcuate shape, respectively.

11. A magnet switch according to claim 9, in which each of said plurality of arms defining said urging portion of said cushion spring include a narrow piece extending radially outwardly from the outer periphery of said annular portion.

* * * * *